US007287717B2

(12) United States Patent
Ropers et al.

(10) Patent No.: US 7,287,717 B2
(45) Date of Patent: Oct. 30, 2007

(54) STRAP DISPENSER WITH START ASSIST

(75) Inventors: Rainer Ropers, Lake Zurich, IL (US); Richard K. Balling, Cary, IL (US); Kevin A. Bruzzesi, Cary, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 325 days.

(21) Appl. No.: 11/051,297

(22) Filed: Feb. 4, 2005

(65) Prior Publication Data

US 2006/0175458 A1 Aug. 10, 2006

(51) Int. Cl.
*B65H 23/06* (2006.01)

(52) U.S. Cl. ..... 242/420.4; 242/419.9; 242/422.8; 242/563

(58) Field of Classification Search ..... 242/420.4, 242/419.9, 422.8, 421.9, 422.9, 422.3, 563, 242/564, 566

See application file for complete search history.

(56) References Cited

U.S. PATENT DOCUMENTS

| | | | | |
|---|---|---|---|---|
| 2,510,187 | A | 6/1950 | Merrifield et al. | |
| 2,637,509 | A | 5/1953 | Stanius | |
| 2,879,011 | A * | 3/1959 | Nelson | 242/421.9 |
| 2,905,406 | A | 9/1959 | Falck-Pedersen | |
| 3,222,008 | A | 12/1965 | Purzycki | |
| 3,228,624 | A | 1/1966 | Brinkman | |
| 3,446,452 | A * | 5/1969 | Tetens | 242/420.4 |
| 3,463,413 | A | 8/1969 | Smith | |
| 3,688,999 | A * | 9/1972 | Plattner et al. | 242/420.4 |
| 3,826,443 | A * | 7/1974 | Goodley | 242/421.9 |
| 3,963,191 | A * | 6/1976 | Goodley | 242/417.3 |
| 4,012,001 | A | 3/1977 | Knox | |
| 4,343,422 | A | 8/1982 | Dabringhaus et al. | |
| 4,400,928 | A | 8/1983 | Watanabe | |
| 4,452,168 | A * | 6/1984 | Gause | 116/200 |
| 4,456,193 | A * | 6/1984 | Westover | 242/421.9 |

(Continued)

FOREIGN PATENT DOCUMENTS

GB 934117 8/1963

OTHER PUBLICATIONS

European Search Report for Application No. EP 02254921.6-2308 dated Dec. 18, 2002; Full document.

*Primary Examiner*—Peter M. Cuomo
*Assistant Examiner*—Sang Kim
(74) *Attorney, Agent, or Firm*—Mark W. Croll; Donald J. Breh; Levenfeld Pearlstein, LLC

(57) ABSTRACT

A dispenser having a start-assist for starting rotation of a coil for dispensing flexible material from the coil includes a frame, a support, a shaft mounted to the support for supporting the coil and configured for rotation with the coil and an arm mounted about the shaft by a one-way element. The arm is connected to the shaft for rotation such that when the arm rotates in a first direction the one-way element engages the shaft to rotate the shaft and when the arm rotates in a second, opposite direction the one-way element is disengaged from the shaft to permit the shaft to freely rotate. When the flexible material is pulled from the coil the arm is rotated in the first direction to begin rotation of the coil by tension in the flexible material.

2 Claims, 3 Drawing Sheets

U.S. PATENT DOCUMENTS 4,899,945 A * 2/1990 Jones ..... 242/420.6
4,905,927 A 3/1990 Lesse
4,917,285 A 4/1990 Shosie
D308,977 S 7/1990 Sakaki
5,079,899 A 1/1992 Kurachi
5,299,407 A 4/1994 Schutter et al.
5,615,538 A 4/1997 Miyashita et al.
6,059,160 A 5/2000 Longrod
6,086,011 A 7/2000 Shibazaki et al.
6,141,946 A 11/2000 Chin-Chang et al.
6,233,910 B1 5/2001 Hataya
6,655,117 B2 12/2003 Hoshino

* cited by examiner

STRAP DISPENSER WITH START ASSIST

BACKGROUND OF THE INVENTION

The present invention pertains to a strap dispenser. More particularly, the present invention pertains to a strap dispenser for use with a strapping machine that assists starting movement of the strap coil upon tensioning of the strap as it is pulled from the coil.

Coil dispensers are used as a source or supply of coil material for many operations. In one application, strapping material is supplied on a coil for use in a strapping machine. Various types of strapping machines are known in the art and will be recognized by those skilled in the art.

The strapping material is fed from the coil to the strapping machine. The coil is supported on a coil dispenser that provides a controlled source of the strapping material to the strapping machine. The dispenser must permit feeding the strapping material to the strapping machine when there is a demand (e.g., as-needed) with little resistance on the material. The dispenser must also, however, prevent the coil from free-rolling (free rotation) so that the strapping material does not continue to feed from the coil when there is no demand for strapping material. To this end, the dispenser must include provisions to slow or brake the coil from free rotation upon a drop in demand.

It will also be recognized that the dispenser coils, particularly when the coil is full, can be quite heavy. As such, a fairly significant force is needed to commence movement (rotation) of the coil, even though the coil is mounted to the dispenser using a low friction roller bearing. This in turn requires that the strapping machine be able to develop a tension in the feed system in order to commence coil rotation.

One known dispenser includes a shaft about which the coil is mounted for rotation. A dancer arm pivots about the coil shaft and a roller is positioned at an end of the dancer arm opposing the arm axis of rotation. A brake assembly is mounted to the dancer arm for movement into and out of engagement with the side plate. The dancer arm is biased such that the brake is in engagement with the side plate. Other known dispensers use an electric brake that is mounted to dispenser at about the shaft to slow or stop that coil upon receipt of a signal from the strapper. None of these known dispensers, however, include any arrangement or provision for starting the coil from a stop. Rather, these are all concerned with stopping the coil to prevent free-rolling or overfeeding.

It is believed that dispensers were configured that use a pneumatic arrangement to assist or to help "push" the coil to start the coil rolling. However, it is not known whether these were successful in use or whether continued use of such coil start devices has been made. Moreover, because of the external assist (i.e., the pneumatic systems), these devices were complex and could require maintenance and attention beyond the value of their commercial use.

Accordingly, there exists a need for a coil dispenser for dispensing strapping material from a coil. Preferably, such a dispenser includes a simple brake mechanism, in conjunction with a start-assist or auto-start mechanism. Desirably, such a dispenser is of a simple design. Most desirably, the start-assist uses mechanical energy and the tensioning of the strap to actuate the start-assist.

BRIEF SUMMARY OF THE INVENTION

A dispenser for dispensing or feeding flexible material, such as strapping, from a coil has a start-assist for starting rotation of the coil. The dispenser includes a frame, a support, a shaft mounted to the support for supporting the coil and for rotation with the coil and an arm mounted about the shaft by a one-way element. The arm is operably connected to the shaft for rotation such that when the arm rotates in a one direction the one-way element engages the shaft to rotate the shaft and when the arm rotates in the opposite direction the one-way element is disengaged from the shaft to permit the shaft to freely rotate. In this manner, when the strap material is pulled (tensioned) from the coil the arm is rotated to begin rotation of the coil.

In addition, the present dispenser includes a brake mechanism, in conjunction with the start-assist. Advantageously, the dispenser is of a simple design and uses the mechanical energy in tensioning of the strap to actuate the start-assist.

A present dispenser includes a roller element disposed on the arm for directing the flexible material to rotate the arm. The one-way element is a one-way clutch that engages the shaft as it rotates in the first direction but allows the shaft to roll freely in the other direction.

The arm pivots between an at rest position and a dispensing position. The arm is biased to the at rest position and the clutch engages as the arm is pivots from the at rest to the dispensing position.

The dispenser can include a strap sensor and rollers disposed adjacent the sensor to maintain the strap moving in a straight line path through the sensor. A present dispenser includes a stop to limit rotation of the arm in the at rest position and a stop to limit rotation of the arm in the dispensing direction.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1A:
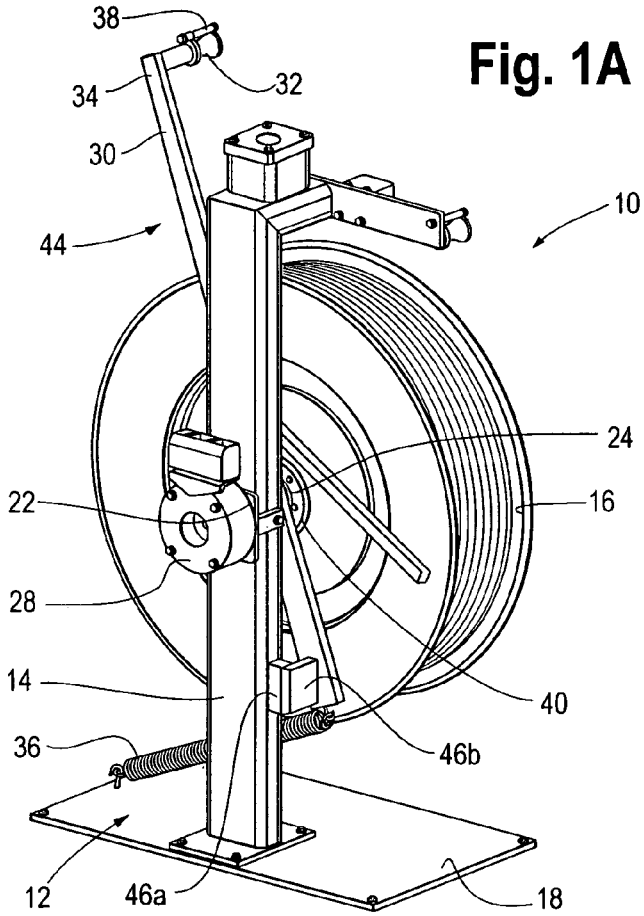
FIG. 1A is a rear perspective view of a strap dispenser with start assist, the dispenser being shown in the at rest position and without strap traversing therethrough.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring now to the figures there is shown an auto-start or start-assist strap dispenser 10 embodying the principles of the present invention. The illustrated dispenser 10 includes generally a frame 12 having a central upright or support 14. The dispenser 10 is configured to accommodate a coil 16 on which a flexible material, such as strapping material S, is stored and to feed the strapping material S from the coil 16 to, for example, a strapping machine (not shown). Those skilled in the art will recognize and appreciate the various types of strapping machines commercially available. The present dispenser 10 is intended for use with most any of these strapping machines and is most suitably used with an automatic type strapper, in which strapping material is fed by a drive assembly around a load, tensioned and sealed to itself. It will also be appreciated that in FIGS. 1B and 2A, the dispenser 10 is shown with strap material S traversing therethrough whereas in FIGS. 1A and 2B, the dispenser 10 is shown without strap material (for ease of illustration and description).

The speeds at which these strapping machines operate is increasing. Likewise, the automation with which they operate is also increasing. To this end, dispensers 10 require operation at high speeds, and their design must take into consideration less operator attention. One way in which the dispenser can contribute to efficient operation of a strapping machine is to reduce the "pull" that the machine is required to exert on the coil 16 in order to start rotation of (and thus feeding from) the coil 16. The present dispenser 10 achieves this by providing an auto-start or start-assist to urge the coil 16 into rotation.

As set forth above, the present dispenser 10 includes a frame 12 having a base 18 and the upright support 14. A shaft 20 is mounted to the support 14 for supporting the coil 16. The shaft 20 is mounted in (through) the support 14 (as indicated at 22) at a roller bearing 24 to permit low friction or low resistance rotation of the coil 16. A nut 26 secures the coil 16 to the shaft 20.

A brake 28 is mounted to the shaft 20 on the exit or opposite side of the support 14. In a present embodiment, the brake 28 is an electric type brake, providing a positive stopping function arrangement. Such brakes will be recognized by those skilled in the art.

Figure 1B:
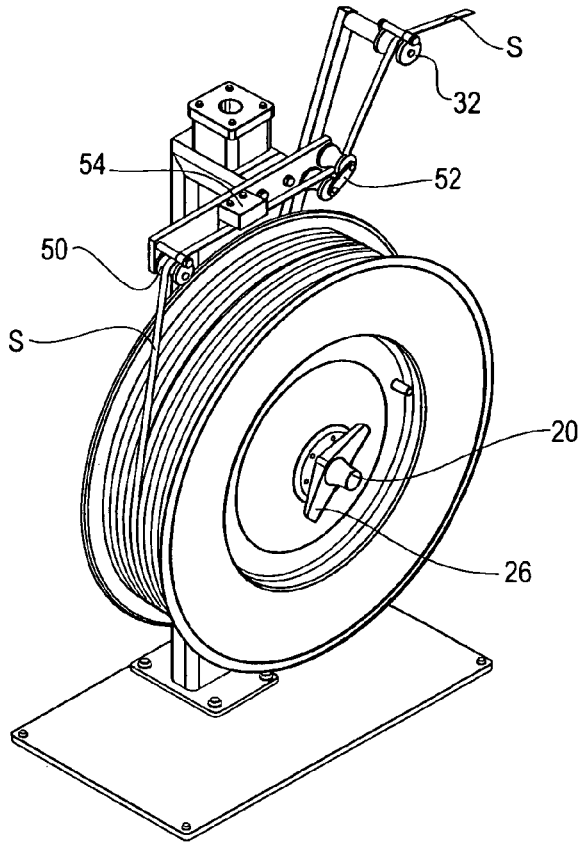
FIG. 1B is a front perspective view of the dispenser also in the at rest position but with strap traversing from the coil over the dancer arm.
Figure 2A:
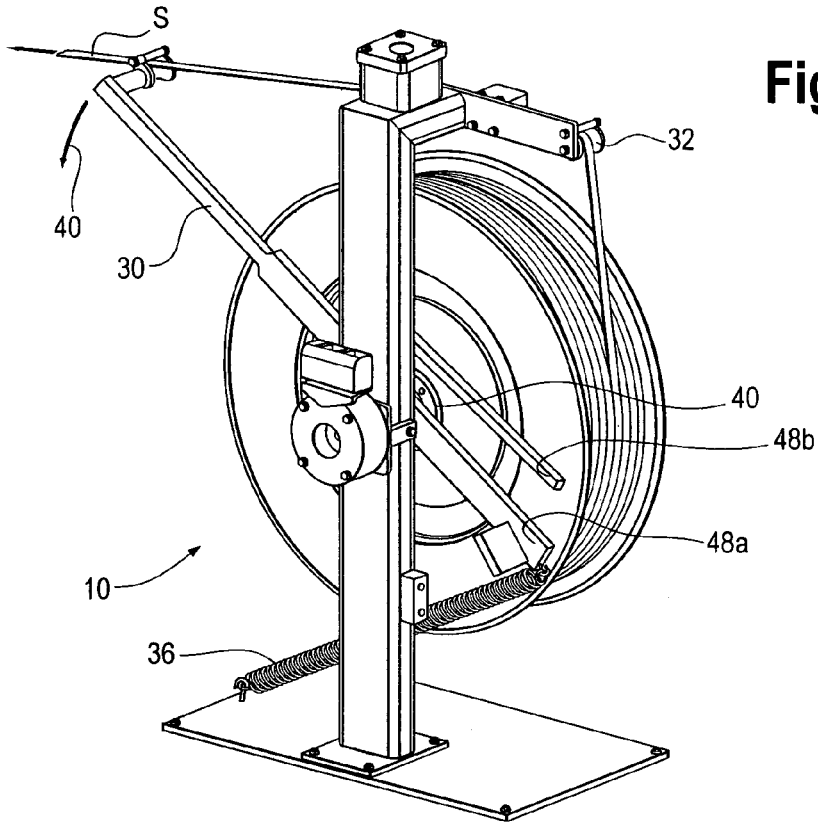
FIG. 2A is a rear perspective view of the strap dispenser shown in the dispensing position with strap traversing through the sensor and over the arm.
Figure 2B:
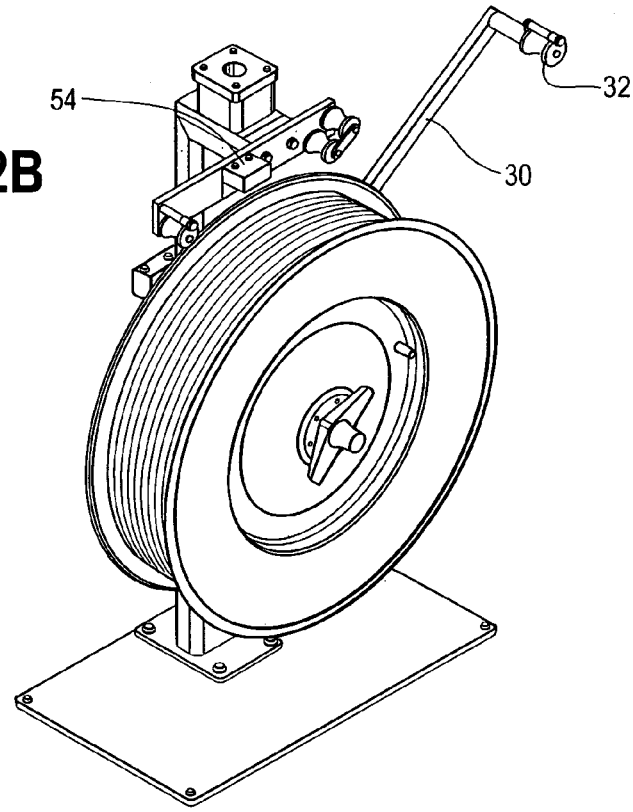
FIG. 2B is a front perspective view of the dispenser in the dispensing position without strap traversing therethrough.

A dancer arm 30 is mounted to the dispenser 10 for pivoting about the shaft 20. The dancer arm 30 has a roller 32 mounted to a free end 34 of the arm 30. The arm 30 is biased to a near vertical position (with the roller 32 above the coil 16, as illustrated in FIGS. 1A and 1B), by a biasing element 36. A secondary roller or guide element 38 can be mounted to cooperate with the roller 32 to prevent the strapping material S from inadvertently slipping from the roller 32. Additionally, the roller 32 can be shaped (such as the illustrated concave-shaped roller) to further prevent inadvertent slipping of the strap S from the roller 32. Bias of the arm 30 is provided in the illustrated dispenser by a coil spring 36, however, it will be recognized by those skilled in the art that other types of biasing elements 36 (such as other types of springs, e.g., torsion springs) can also be used in the present dispenser 10.

Figure 3:
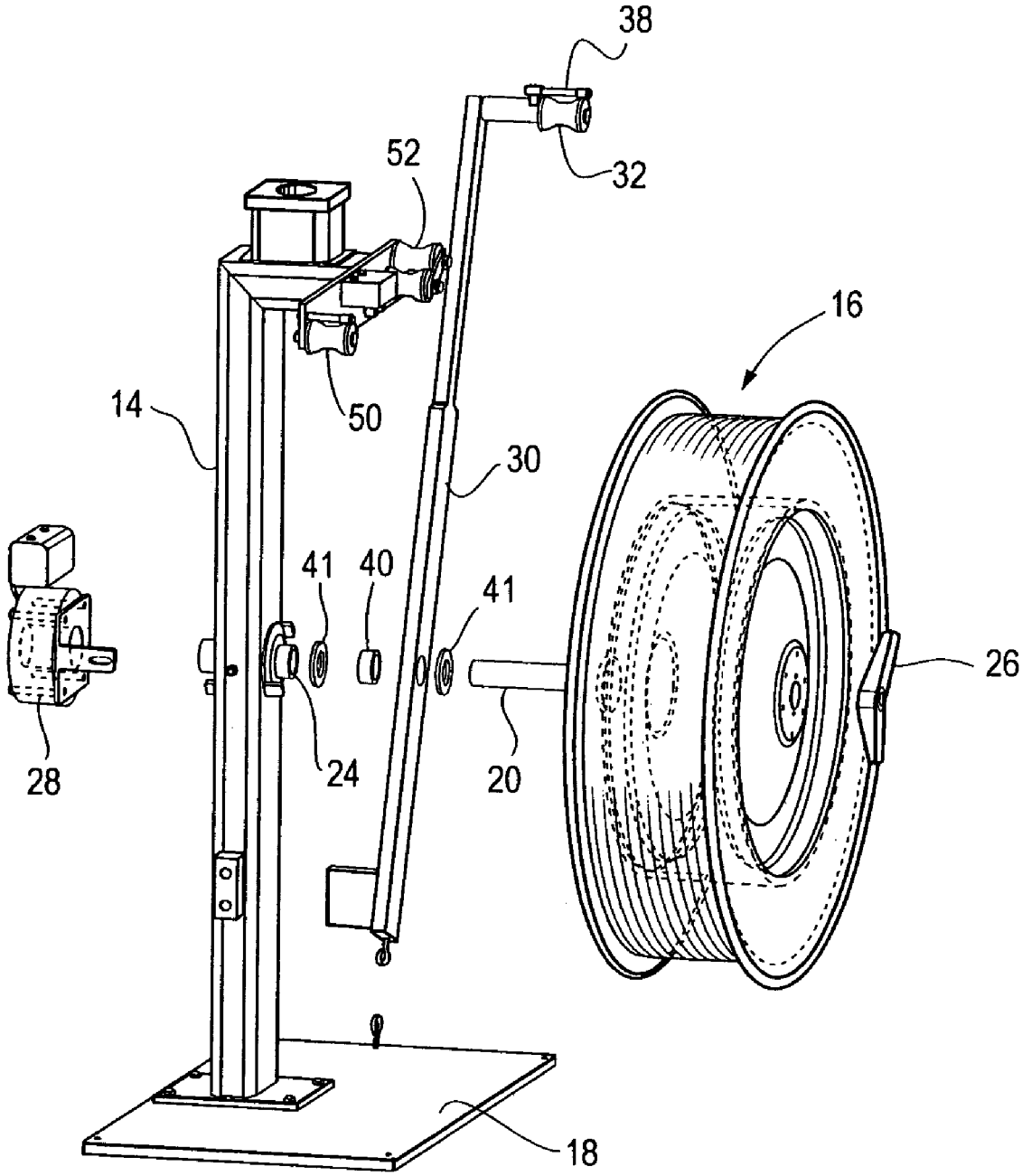
FIG. 3 is an exploded view of the dispenser.

The dancer arm 30 is mounted to the shaft 20 by a one-way clutch 40. In this arrangement, the arm 30 grasps (or holds) the shaft 20 as the arm 30 pivots in one direction (against the bias, as indicated by the arrow at 42) and moves freely about the shaft 20 as the arm 30 pivots in the opposing direction (in the direction of the bias as indicated by the arrow at 44). In the illustrated embodiment, as the arm 30 rotates downward, away from the vertical, it rotates the coil 16 by action of the clutch 40, whereas the spring 36 returns the arm 30 to the near vertical position without effecting rotation of the coil 16 (by slipping of the clutch 40). Washers 41 are disposed on between the clutch 40 and the upright 14 and between the arm 30 and the coil 16, as seen in FIG. 3. In this manner, as the arm 30 is pivoted or pulled against the spring 36 bias, it grasps and rotates the shaft 20, however, the arm 30 moves freely back (returns) to the near vertical position by action of the spring 36. For purposes of the present discussion, the vertical or near vertical position (FIGS. 1A and 1B) is referred to as the at-rest position and the bias-tensioned position (FIGS. 2A and 2B) is referred to as the dispensing position.

In order to prevent over-rotation of the arm 30 in the at rest position, the arm 30 and support 14 include cooperating stop elements 46*a,b* that physically stop the arm 30 in the at-rest position. The dispenser 10 can also include stops 48*a,b* at the dispensing position to prevent over rotation of the arm 30 in that direction.

The illustrated dispenser 10 includes additional rollers and/or guides 50 and 52 to direct the strap S toward and over the dancer arm roller 32 and to maintain the strap S moving in a straight line direction when, for example, the strap S traverses through a sensor 54.

In use, strapping material S is fed through the sensor rollers 50 and 52 and through the sensor 54 and is looped over the dancer arm roller 32 (between the roller 32 and the guide 38) and is introduced to the strapping machine (not shown). As strapping material S is needed by the strapping machine, the material S is "pulled" from the coil 16. As the material S is pulled, the arm 30 begins to pivot from the at-rest position (FIG. 1A) to the dispensing position (FIG. 2A), against the spring 36 bias. As the arm 30 moves in this direction, the clutch 40 is engaged and rotates the shaft 20 to auto-start, or start-assist the coil 16 in rotation. The arm 30 is maintained in the dispensing position as strap S is pulled from the dispenser 10, but since the clutch 40 is a one-way clutch, the shaft 20 (and thus the coil 16) is allowed to rotate freely. As slack develops in the strapping material S, the spring 36 overcomes the tension in the strapping material S and the arm 30 is urged back to the at-rest position (FIGS. 1A and 1B), again, without affecting (e.g., retarding) rotation of the coil 16.

The present dispenser 10 arrangement provides a number of benefits, such as actuation of the start-assist feature by virtue of the demand (pull) on the strap S. Thus, no external sources (e.g., power such as pneumatics) are required to provide this assist. In addition, the present dispenser 10 design is relatively simple, and uses, for the start-assist, only a mechanical arrangement of elements. Although the brake 28 illustrated is of an electrical or electro-mechanical design, those skilled in the art will recognize the various brake configurations that can be used in the present dispenser 10.

All patents referred to herein, are hereby incorporated herein by reference, whether or not specifically do so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A strap dispenser having a start assist for starting rotation of a strap coil for dispensing flexible strap material from the strap coil comprising:

a frame;

an upright support;

a shaft mounted to the support for supporting the strap coil and configured for rotation with the strap coil mounted thereon;

an arm mounted about the shaft by a one-way element consisting essentially of a slipping clutch, the arm being operably connected to the shaft for rotation such that when the arm rotates in a first direction downward, the one-way element of a slipping clutch engages the shaft to rotate the shaft and to rotate the strap coil and when the arm rotates in a second opposite direction, the arm is at-rest biased to return the arm to a near-vertical at-rest position by a biasing element, the one-way element of a slipping clutch disengages from the shaft to permit the shaft and the effecting strap coil to freely rotate without effecting rotation of the strap coil by slipping of the clutch; wherein when the flexible strap material is pulled from the strap coil, the arm is rotated in the first deviation downward to begin rotation of the strap coil by tension in the flexible material, wherein the arm is biased to return the arm to a near-vertical at-rest position without effecting rotation of the strap coil by slipping of the clutch; and a strap sensor wherein additional rollers and guides direct the strap toward and over a concave-shaped roller element disposed on a free end of the arm to maintain the strap moving in a straight line direction when the strap traverses through the sensor.

2. strap dispenser in accordance with claim 1 including four concave-shaped rollers disposed adjacent the sensor to maintain the strap moving in a straight line path through the sensor.

* * * * *